United States Patent [19]

Alley

[11] 4,101,806

[45] Jul. 18, 1978

[54] BALLAST EMI AND SHOCK HAZARD REDUCTION

[75] Inventor: Robert P. Alley, Manlius, N.Y.

[73] Assignee: General Electric Company, Carmel, Ind.

[21] Appl. No.: 718,028

[22] Filed: Aug. 26, 1976

[51] Int. Cl.[2] ..... H05B 37/00; H05B 41/14

[52] U.S. Cl. ..... 315/86; 315/278; 328/7; 361/35; 361/38

[58] Field of Search ..... 315/276, 278, 279, 105, 315/86; 328/7; 331/63; 361/35, 38

[56] References Cited

U.S. PATENT DOCUMENTS

| | | | |
|---|---|---|---|
| 2,682,014 | 6/1954 | Feinberg | 315/278 X |
| 3,160,784 | 12/1964 | Strecker | 328/7 X |
| 3,176,187 | 3/1965 | Sola | 328/7 X |
| 3,333,150 | 7/1967 | Eppert | 315/105 X |
| 3,386,003 | 5/1968 | Partridge | 328/7 X |
| 3,631,322 | 12/1971 | Kruger | 361/38 |
| 3,906,243 | 9/1975 | Herzog | 315/86 |

*Primary Examiner*—Saxfield Chatmon, Jr.

[57] ABSTRACT

A ballast for operating a pair of fluorescent lamps includes an isolation transformer with a split secondary winding. A power capacitor is connected serially between the two sections of the secondary for reducing shock hazard associated with leakage current resulting when a high frequency emergency lighting circuit is operational and further, for minimizing transference of EMI from the lamp side of the ballast to the line side.

2 Claims, 3 Drawing Figures

BALLAST EMI AND SHOCK HAZARD REDUCTION

BACKGROUND OF THE INVENTION

1. Field of the Invention

The present invention relates to a ballast for a pair of gaseous discharge lamps, and more particularly, to a fluorescent lamp ballast having means for reducing leakage current shock hazard and for minimizing EMI transfer from the load side to the line side.

2. Description of the Prior Art

U.S. Pat. No. 3,906,243 — Herzog, assigned to the assignee of the present invention, discloses the concept of a retrofit type of emergency/normal fluorescent lighting system wherein some problems associated with the incorporation in the same enclosure of a high frequency battery driven oscillator and a power frequency ballast were solved. However, one difficulty found with this approach is that of low lamp light output in the normal line AC or power frequency mode. The ballast disclosed in the U.S. Pat. No. 3,906,243 — Herzog, is of the lag type and with the size and temperature rise constraints imposed by the package, is able to deliver only about 40 - 45% of the rated light output of the fluorescent lamp. With this lag ballast design, current in the lamp circuit is that associated strictly with the lamp, being limited by the leakage reactance or self-inductance of the ballast transformer secondary winding. The primary winding is loosely coupled to the secondary and the current reflected in this primary winding is that associated with lamp load; however, since the power factor is approximately 50%, the current in the primary approaches double that normally expected. The Herzog U.S. Pat. No. 3,906,243 shows a way of coupling the high frequency oscillator into the system so that stray capacitance associated with the secondary winding exists between any lamp terminal and ground; such limits to safe values the leakage current which may be intercepted by a careless worker.

To improve power factor and to minimize volt-amperes in a ballast for operating a pair of gaseous discharge lamps, a lead circuit secondary may be employed to yield an approximately unity power factor in the primary, thereby reducing primary current by almost a factor of two and therefore primary size and heating by something approaching a factor of three to four.

A typical prior art circuit is shown in FIG. 1 for such a lead secondary ballast for operating a lamp from AC line voltage in conjunction with a high frequency oscillator, inverter 50, including a DC source for operating the lamp at a high frequency upon failure of the AC source. Such a circuit is non-symmetrical but isolated as seen in the figure. This type of circuit arrangement solves the power frequency ballasting light output problem but places all the stray capacitance of the power capacitor 40 on one ballast lead. If the high frequency oscillator 50 is attached as shown and is operating, a person grabbing terminal B when the lamp 12' has been removed from the fixture may complete a path to the high frequency oscillator through stray capacitance associated with the power capacitance 40 to the ballast case (not shown) and back to terminal A. The effect is that worst case leakage to ground may exceed double the maximum allowed by UL standards. Furthermore, this isolating secondary circuit arrangement also allows the transfer of high frequency noise, EMI, which is, for example, generated by a lamp, to the AC line or to ground. Such noise coupling results due to the power capacitor acting like a short circuit at high frequencies because of its position in the circuit and its associated relatively high capacitance to ground.

It is desirable, therefore, to provide a ballast for operating at least one gaseous discharge lamp wherein the leakage current to ground is reduced and transference to the ballast line side and to ground of EMI generated by the at least one gaseous discharge lamp is minimized.

Accordingly, it is an object of the present invention to provide a ballast for operating at least one gaseous discharge lamp from AC line voltage wherein means are provided for reducing the shock hazard resulting from leakage current in the ballast and for minimizing the transfer of high frequency interference from the load side of the ballast to the AC line side and to ground.

SUMMARY OF THE INVENTION

In accordance with the present invention, there is provided an improved ballast for operating at least one gaseous discharge lamp at high power factor from AC line voltage, the ballast being of the type having a line side for connection to a source of AC line voltage and having a load side for connection to the at least one gaseous discharge lamp, the improvement comprising means for reducing hazard associated with leakage current in the ballast and for minimizing transference of EMI from the load side to the line side and to ground. In the preferred embodiment, this advantageously includes an isolation transformer in the ballast having at least a primary winding and a secondary winding, the secondary winding being divided into two portions, and a power capacitor connected serially in circuit between the two portions of the secondary winding.

DESCRIPTION OF THE PREFERRED EMBODIMENT

Figure 1:
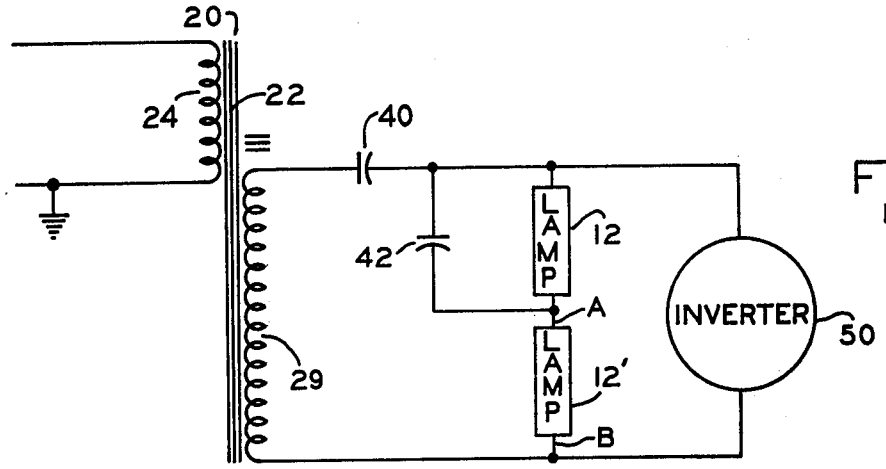
FIG. 1 PRIOR ART
FIG. 1 is a schematic representation of a prior art, isolated lead secondary type of ballast circuit for operating a pair of fluorescent lamps from AC line voltage, a high frequency retrofit emergency lighting system being connected in circuit.
Figure 2:
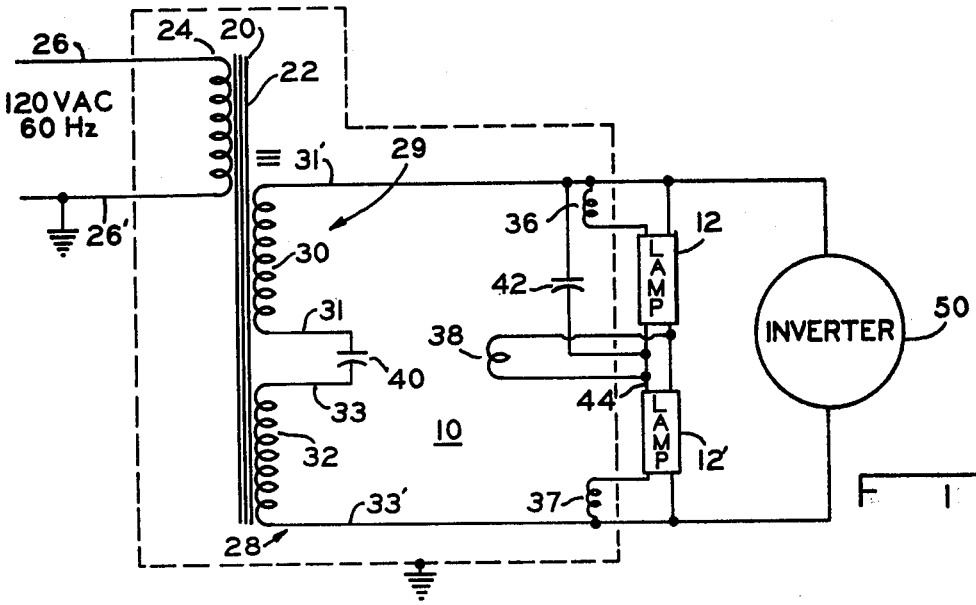
FIG. 2 is a schematic representation of one form of the preferred embodiment of the improved ballast circuit of the present invention, in association with a retrofit emergency lighting system.

Referring to FIG. 2, there is shown one form of the preferred embodiment of a ballast made in accordance with the present invention and incorporated in a retrofit emergency lighting system. Ballast 10 serves to operate at least one gaseous discharge lamp, (in this embodiment, a pair of fluorescent lamps 12 and 12') at high power factor from AC line voltage, such as, for example, 120 volt AC, 60 Hz. Included is an isolation transformer 20 having a core 22 and a line side taking the form of a primary winding 24 having a pair of leads 26, 26' for connection to the source of AC line voltage. Transformer 20 also includes a load side 28 for connection to the fluorescent lamps.

In accordance with the teachings of this invention, means are provided for reducing the hazard associated with leakage current in the ballast and for minimizing the transfer of EMI, electromagnetic interference, or high frequency noise, from the load side to the line side of the ballast and to ground. Load side 28 includes a loosely coupled secondary winding 29 divided approximately equally into two portions or sections 30 and 32. Section 30 has a pair of end leads 31 and 31', the latter being provided for connection to the lamps. Section 32 has a pair of end leads 33 and 33', the latter also being provided for connection to the lamps. A power capacitor 40 is connected serially in circuit between the two portions of the secondary winding 30 and 32 through physical connection with leads 31 and 33. Heater windings 36, 37 and 38 are provided for rapid starting lamps 12 and 12' when they are to be operated from 120 V AC. A second capacitor 42 is provided connected at one end to terminal 31' and at the other end to a lead 44 connecting the lamps 12 and 12'.

For operation of the lamps from a DC source, such as a battery, upon failure of the AC line voltage, there is shown, in block form, an inverter unit 50 including a battery for this retrofit emergency lighting system. Inverter unit 50 takes over, upon failure of the line voltage, to operate lamp 12' at high frequency, such as, for example, 3.5 K Hz. Further details applicable to the operation of such a retrofit inverter unit may be had by referring to U.S. Pat. No. 3,836,815 — Herzog, assigned to the assignee of the present invention.

In a ballast for fluorescent lamps as shown in FIG. 2, wherein the secondary winding is split into two approximately equal portions, advantage may be taken of the high frequency inductance of the two halves and of the location of the power capacitor 40. Using this technique, high frequency current which may flow from either of the terminals of lamp 12' if the lamp is removed from the circuit, must go through at least one half the inductance of the secondary winding before it may flow through the stray capacitance of the relatively large power capacitor 40 to the ballast outer case (shown by dotted lines) and hence to ground.

With the arrangement of the present invention, such high frequency hazard current may be limited to less than 5 milliamperes under all conditions, even when, as here, two lamps are connected in series across the ballast output with a start capacitance 42 connected across one of the lamps (12). This technique also allows the use of the same size of 60 Hz ballast laminations as previously employed but yields 50% (of the 40 – 45%) more light output from the ballast than could be obtained with the configuration of Herzog in U.S. Pat. No. 3,906,243 without exceeding any of the size, safety or heating considerations of necessity met by the Herzog ballast.

While the discussion heretofore has concerned itself primarily with the use of the disclosed ballast arrangement in conjunction with retrofit emergency lighting systems, the technique is also useful in reducing high frequency leakage current to ground in those installations in hospitals and other lighting systems monitored by ground fault protectors. The disclosed technique may also be employed to reduce the amount of radio frequency noise, EMI, which may be transferred across the ballast into the AC line end to ground.

Figure 3:
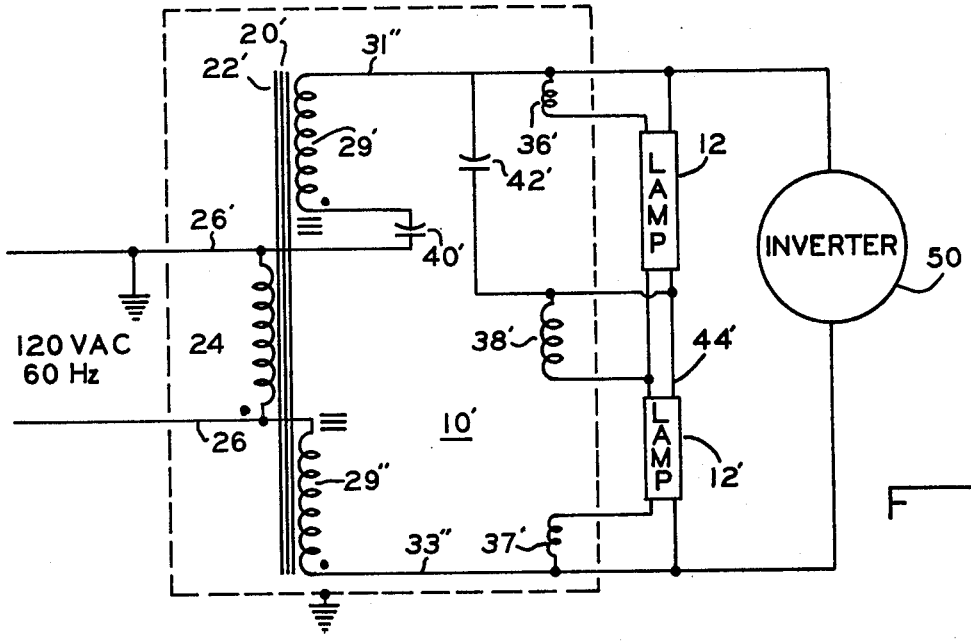
FIG. 3 is a schematic representation of another form of the preferred embodiment of the present invention, also in association with a retrofit emergency lighting system.

The ballast of FIG. 2 has been built and operated satisfactorily with components having the following values:

Primary winding 24:1516 turns, 0.0195 in. dia. wire
Secondary winding 29, Sections 30, 32:1053 turns, 0.0122 in. dia. wire, each section
Filament windings 36, 37 and 38:30 turns, 0.0122 in. dia. wire, each
Power capacitor 40:1.9 uf
Capacitor 42:0.05 ufd
Lamps 12, 12':40 watt rapid start fluorescent For minimizing EMI transference and leakage current where conditions do not require complete isolation, an autotransformer arrangement as shown in FIG. 3 may be used. In this form of the preferred embodiment, ballast 10' includes a transformer 20' including a primary winding 24' with a pair of leads 26, 26' for connection to the source of AC line voltage; lead 26' is grounded. A first loosely coupled secondary winding 29' is provided and is connected to primary winding 24' through a power capacitor 40'. A second secondary winding 29'' is connected to the primary winding 24' also in autotransformer relationship. A pair of output leads 31'' and 33'' are provided for connection to lamps 12 and 12'. A trio of heater winding 36', 37' and 38' are provided magnetically coupled with transformer 20'. A second capacitor 42' is provided connected at one end to lead 31'' and at the other end to a lead 44' connecting lamps 12 and 12'.

It will be apparent to those skilled in the art that the embodiments described heretofore are considered to be the presently preferred forms of the invention and are not limitative thereof. In accordance with the Patent Statutes, changes may be made in the disclosed apparatus and the manner in which it is used without actually departing from the true spirit and scope of this invention.

What is claimed is:

1. In an electrical system for operating at least one gaseous discharge lamp from a line voltage AC source and upon failure of the AC source, from a DC energized, high frequency emergency circuit, the improvement comprising:

a ballast for operation from the AC source at high power factor, the ballast having means for reducing hazard associated with leakage current therein resulting from operation of the high frequency emergency circuit and for minimizing transference of EMI from the lamp side thereof to the AC source side thereof and to ground including an isolation transformer having at least a primary winding and a secondary winding; the secondary winding being divided into two portions; and a power capacitor connected serially in circuit between the two portions of the secondary winding.

2. The invention of claim 1 wherein the two portions of the secondary winding are approximately equal.

* * * * *